US006630905B1

(12) United States Patent
Newberg et al.

(10) Patent No.: US 6,630,905 B1
(45) **Date of Patent: *Oct. 7, 2003**

(54) SYSTEM AND METHOD FOR REDIRECTING A SIGNAL USING PHASE CONJUGATION

(75) Inventors: Irwin L. Newberg, Pacific Palisades, CA (US); Mary G. Gallegos, Agoura Hills, CA (US); Robert A. Mika, Manhattan Beach, CA (US)

(73) Assignee: Raytheon Company, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/710,240

(22) Filed: Nov. 10, 2000

(51) Int. Cl.[7] ..... H01Q 1/00
(52) U.S. Cl. ..... 342/370
(58) Field of Search ..... 342/370

(56) References Cited

U.S. PATENT DOCUMENTS 2,908,002 A 10/1959 Van Atta
4,148,031 A * 4/1979 Tausworthe
4,233,606 A * 11/1980 Chernoff
6,128,276 A * 10/2000 Agee ..... 370/208

OTHER PUBLICATIONS

Vladimir V. Shkunov and Boris Ya. Zel'Dovich, Optical Phase Conjugation, Scientific American, Dec. 1985, pp. 54–59.

Chang, Fetterman, Newberg and Panaretos, Microwave Phase Conjugation Using Antenna Array, IEEE Transactions on Microwave Theory and Techniques, vol. 46, No. 11, Nov. 1998.

Newberg, Space Based Radar System RF Signal Redirection, Proposal for National Reconnaissance Office, Nov. 17, 1999.

* cited by examiner

*Primary Examiner*—Theodore M. Blum
(74) *Attorney, Agent, or Firm*—Leonard A. Alkov; Glenn H. Lenzen, Jr.

(57) ABSTRACT

A system and method for automatically generating a return beam in the direction of a received beam. The inventive system (10) includes a phased array antenna (12) for receiving a radio frequency signal having a first wavefront from a first direction. In response to this signal, the invention (10) provides a second signal having a second wavefront. The second signal is a phase conjugate of the first signal and is transmitted in a reverse direction relative to the direction of the first signal. In the illustrative embodiment, the invention includes a plurality of phase conjugators each of which are disposed in a transmit/receive module and coupled to an associated radiating element. Each of the phase conjugators includes a mixer (60) having the input signal as a first input thereto. The input signal has a first frequency and a first phase. A second signal having a frequency equal to twice the first frequency is input to each mixer (60) from a reference frequency module (30) such that the output of the mixer includes a component representative of the negative of the first phase. The output of each mixer (60) is filtered to extract a signal component having a negative phase relative to the input signal. These signal components are then transmitted as the phase conjugated wavefront. This process will occur for each signal when multiple signals are received within the field of regard of the phased array antenna (12).

9 Claims, 5 Drawing Sheets

* Phase conjugated $(\omega_r t+\phi)$

– – - RF phase conjugation circuits added to conventional T/R module $2\omega_r$ is a signal generated using $\omega_r$

SYSTEM AND METHOD FOR REDIRECTING A SIGNAL USING PHASE CONJUGATION

BACKGROUND OF THE INVENTION

1. Field of Invention

The present invention relates to RF systems. More specifically, the present invention relates to phased array antenna systems used for RF systems and other applications.

2. Description of the Related Art

For many applications, it is necessary or desirable to be able to automatically track a received signal. In a radar or communication application, for example, it might be useful to be able to track a source of a received signal. A satellite or another RF signal, for example, might be tracked and a return signal automatically transmitted back to the satellite or RF signal source in response thereto. Hence, an automatic tracking system might allow for more effective and efficient direction of a return beam to complete an RF signal source or communication link.

Conventionally, beam tracking has involved physically pointing an antenna in the direction of the received beam and processing the received signal with a tracking algorithm to steer the antenna in the direction of the received signal. This approach can be problematic inasmuch as it requires the steering of a physical antenna and is therefore relatively computationally intensive, slow and costly.

Thus, while phased array antennas have been used for some time, automatic beam steering in response to an RF signal with a phased array antenna has been somewhat problematic to date.

Hence, a need remains in the art for an improved system and method for automatically tracking a beam and steering a transmit beam in response thereto.

SUMMARY OF THE INVENTION

The need in the art is addressed by the system and method of the present invention. The inventive system includes a first mechanism for receiving a first signal having a first wavefront from a first direction. A second arrangement provides a second signal having a second wavefront. The second signal is a phase conjugate of the first signal. A third mechanism is included for transmitting the second signal. The second signal is transmitted in a reverse direction relative to the direction of the first signal.

In the illustrative embodiment, the first mechanism is a phased array antenna comprising a plurality of radiating elements and the first signal is a radio frequency signal. The wavefront that is received, phase conjugated and transmitted is a sampled wavefront of the wavefront being received. The second arrangement includes a plurality of phase conjugators each of which are coupled to an associated radiating element to receive an input signal therefrom. The phase conjugator output has a signal which is the negative of the first signal's phase and this output is then transmitted. In an illustrative embodiment, the second arrangement also includes a plurality of phase conjugators each of which are coupled to an associated radiating element to receive an input signal therefrom. Each of the phase conjugators includes a mixer, as the phase conjugator, said mixer having the input signal as a first input thereto. The input signal has a first frequency and a first phase. A second signal having a frequency equal to twice the first frequency is input to each mixer such that the output of the mixer includes a component representative of the negative of the first phase. The output of each mixer is filtered to extract the component representative of the negative of the first phase and transmitted.

The inventive method, then, involves an adaption of a radar (or other suitable system) to utilize phase conjugation, where phase conjugation means reversing the phase factor of the incident wavefront. A phase conjugated RF wavefront, for example, propagates backward in space and time with the same wavefront as the original incoming wave. In the illustrative embodiment, the invention uses a received RF signal from an RF source as a sampled reference signal to be phase conjugated by the radar phased array antenna. Phase conjugation of an Electromagnetic (EM) wavefront using an antenna array can be described as the process of automatically configuring the phased-array antenna system to direct its outgoing signals to retrace *an incoming signal's path exactly back to its source. This automatic signal redirection capability is provided by using a phase conjugation technique in each transmit/receive. (T/R) module of a phased array radar. The illustrative technique is to use a mixer in each T/R module to generate the phase conjugated signal by mixing the sampled received signal wavefront with a signal that is twice the frequency of the received signal. This above operation can occur for a plurality of received signal wavefronts, each from a different direction, as long as each RF signal is within the field of regard of the antenna. The field of regard can be defined in general as the antenna beamwidth of an individual antenna radiator.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
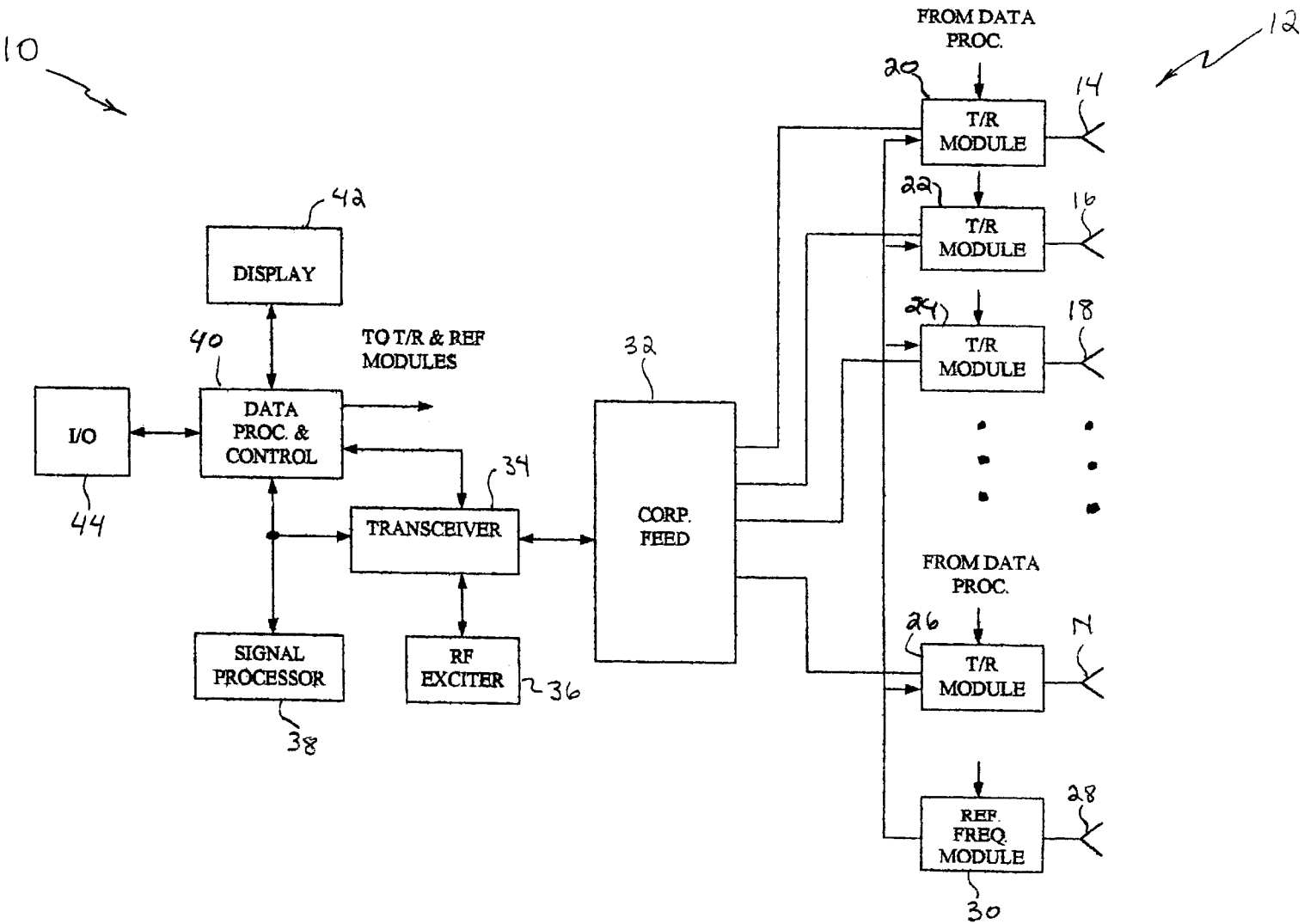
FIG. 1 is a block diagram of an illustrative embodiment of a radar or communications system implemented in accordance with the teachings of the present invention.

FIG. 1 is a block diagram of an illustrative embodiment of an RF radar or communications system implemented in accordance with the teachings of the present invention. The system 10 includes a phased array antenna 12 adapted to transmit and receive radio frequency (RF) signals via a plurality of radiating elements 14, 16, 18 . . . N and 28 connected to a number of associated T/R modules 20, 22, 24 . . . 26 and a reference frequency module 30. In accordance with the present teachings, the T/R modules phase conjugate the received beam using a signal from the reference frequency module as discussed more fully below.

Then each module is coupled to a conventional corporate feed network 32. The feed network 32 is coupled to a transceiver 34 of conventional design. The transceiver 34 downconverts received signals and upconverts signals for transmission using signals provided by an RF exciter 36. Signals to and from the transceiver are processed by a conventional signal processor 38 and a conventional data processor and controller 40. A display 42 and an input/output interface 44 are provided as is common in the art.

The present invention teaches the application of phase conjugation (i.e., reversing the phase factor of a received signal) in order to significantly improve the system's capability to receive and redirect signals in new modes without appreciable signal processing. For the illustrative RF (radar) application, a phase conjugated RF wave propagates backward in space and time with the same wavefront as the original incoming wave. In accordance with the present teachings, phase conjugation technology is applied to phased array radars for redirecting received RF signals with minimal signal processing.

Phase conjugation is by its nature an automatic process for auto-tracking of an incoming signal. The process does not need any control for its generation and thus does not typically need to have available data for target detection, range, and angle location. For any antenna application a received signal is the signal that is needed as an input seed signal to be phase conjugated. This input seed signal can come from any source. In accordance with the present teachings, phase conjugation is effected in the T/R modules of a phased array antenna. In this and all following the processes described occur simultaneously or sequentially for a plurality of received signals within the physical laws of conservation of energy, that is if simultaneous signals are received, the total system redirected signal amplifier is shared between each signal.

Figure 2:
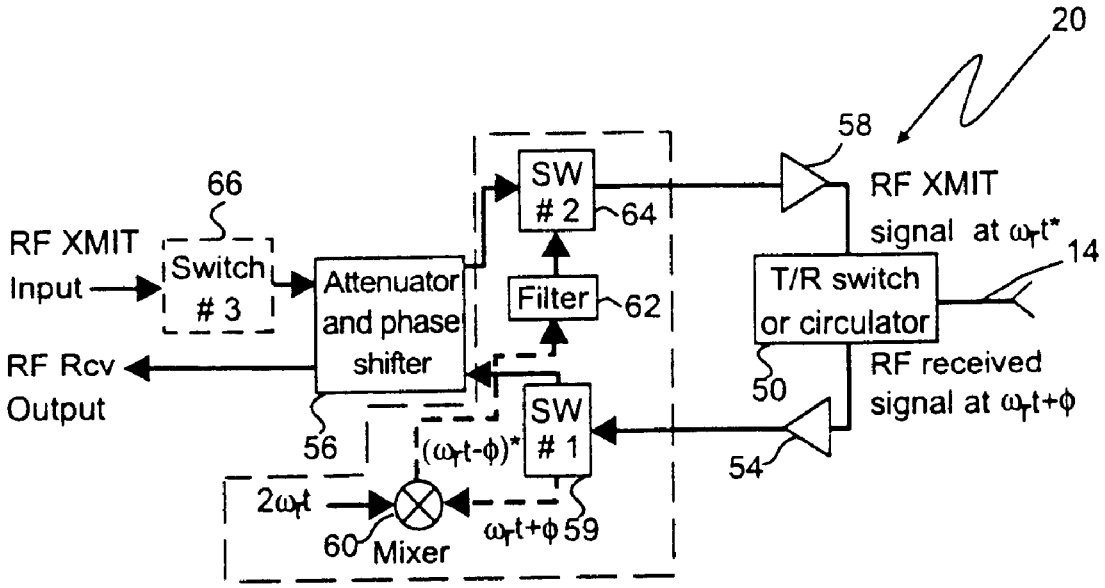
FIG. 2 is a block diagram showing an illustrative implementation of a T/R module in accordance with the teachings of the present invention.

FIG. 2 is a block diagram showing an illustrative implementation of a T/R module in accordance with the teachings of the present invention. As all of the T/R modules are of identical construction, only the first module 20 is described in detail. Each module includes a switch or circulator 50 adapted to connect either a receive circuit or a transmit circuit to an associated radiating element 14 as is common in the art. The receive circuit conventionally includes an amplifier 54, and an attenuator and phase shifter 56. The transmit circuit conventionally includes the attenuator and phase shifter 56 and a transmit amplifier 58.

In accordance with the present teachings, a phase conjugation circuit is included in each T/R module. The phase conjugation circuit includes a first switch 59 in the receive path between the receive amplifier 54 and the attenuator and phase shifter 56, a mixer 60, a filter 62 and a second switch 64 between the attenuator and phase shifter 56 and a transmit amplifier 58. The first switch 59 selects between the attenuator and phase shifter and the mixer 60. The first and second switches 59 and 64 are selectively activated by a signal from the data processor 40 of FIG. 1. When activated, the first switch 59 directs the received signal to the mixer 60. The received signal is of the form $\omega_r t+\phi_r$, where $\omega_r$ is the received signal frequency and $\phi_r$ is the phase of same. The "ω" is defined as 2πf where f is the frequency and ωt represents the signal phase. In the following ω and ωt are used to represent the received signal.

In accordance with the present teachings, the received signal is mixed with a signal of the form $2\omega_r+\phi_{ref}$ supplied by the reference frequency module 30.

Figure 3:
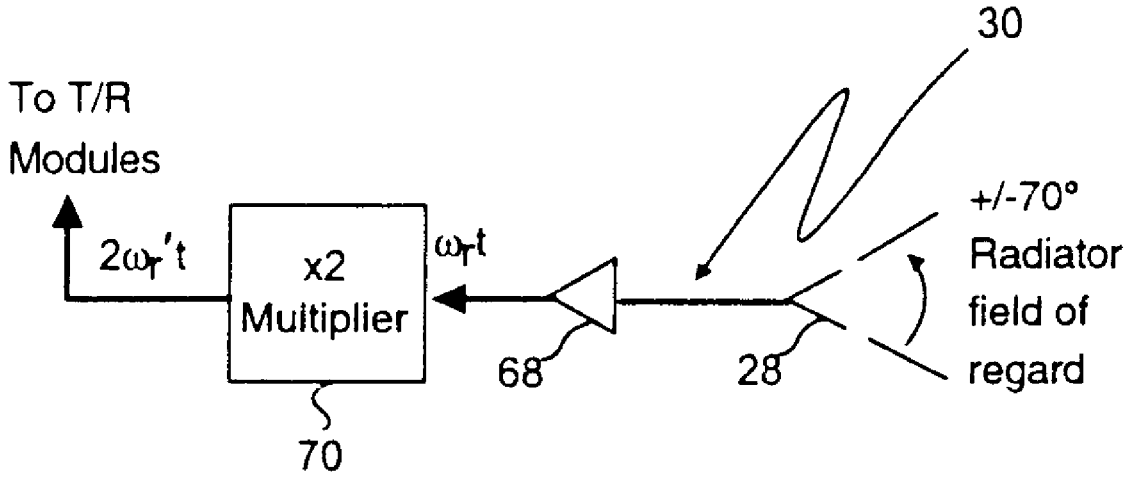
FIG. 3 is a diagram of an illustrative embodiment of the reference frequency module in accordance with the teachings of the present invention.

FIG. 3 is a diagram of an illustrative embodiment of the reference frequency module in accordance with the teachings of the present invention. The module 30 is connected to a radiating element 28 and includes an RF amplifier 68 and a times 2 multiplier (frequency doubler). The output of the multiplier is the signal of the form $2\omega_r+\phi_{ref}$ and is input to the mixer 60 of each module where $\phi_{ref}$ is a reference phase. In the best mode, this signal is communicated to each module via microstrip or other transmission lines of equal electrical lengths so as to preserve the reference phase relationships thereof, notwithstanding the fact that ,ref may be an arbitrary reference phase in practice.

Returning to FIG. 2, the output of the mixer is the sum (Σ) $(3\omega_r+\phi)$ and difference (Δ) $(\omega_r-\phi)$ of the two input signals $(\omega_r+\phi)$ and $2\omega_r$ where the t has been left off and also the $\phi_{ref}$. Accordingly, the signal output by the mixer 60 is a signal of the form:

$$\Sigma \text{ and } \Delta=(3\omega_r+\phi) \text{ and } (\omega_r-\phi) \quad [1]$$

Note the $-\phi$ term in $(\omega_r-\phi)$, the phase conjugate of the input signal $(\omega_r+\phi)$. This phase conjugate $(\omega_r-\phi)$ term is extracted by the filter 62 before being switched to the transmit amplifier 58 by the second switch 64. As a consequence, the phase relationships between the radiating elements are preserved while the phase conjugate wavefront is created. This conjugated signal is then transmitted through the antenna elements back to the signal source. Once initiated, the process will continue without any control until the received signal goes out of the entire radar field-of-regard determined by the wide beam pattern of each single antenna radiator.

To understand physically how and why antenna array phase conjugation can direct an RF signal back to a signal source via the same path that the received signal has traversed and do this in the presence of a distorting medium, consider the following.

Figure 4:
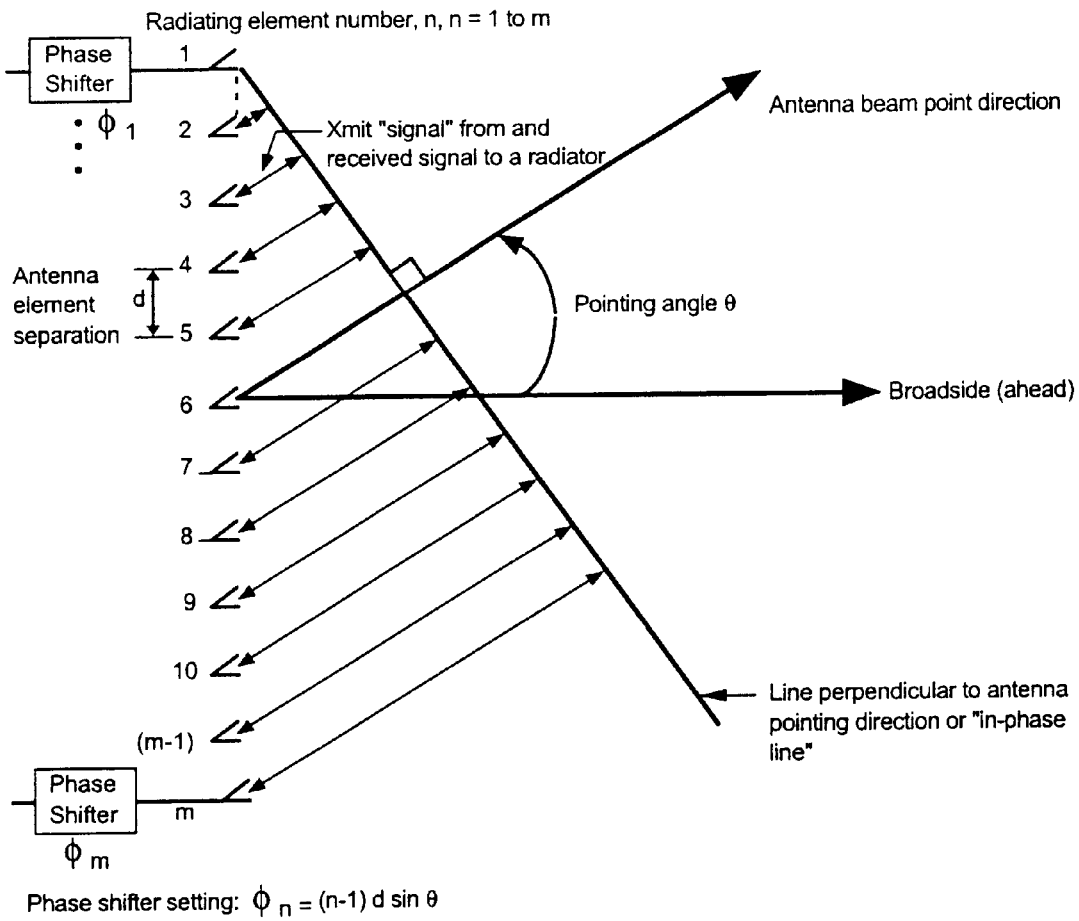
FIG. 4 is a diagram illustrating typical conventional radar phased array antenna pointing.

FIG. 4 is a diagram illustrating typical conventional radar phased array antenna pointing. The beam of a phased array antenna is typically pointed to an angle θ for a given frequency by establishing a relative phase difference φ ($\phi_1$ to $\phi_m$) at each element in the array such that the RF radiated (transmit, xmit) signals from each array element (i.e., T/R module) add up in phase along an imaginary line that is perpendicular to the antenna pointing direction (termed here the in-phase line) as shown in FIG. 4. The output then travels as a in-phase wavefront in the pointing direction to the target. The phase settings at each element, n, are calculated by adding the relative phase, Δφ, shown in FIG. 4, to a nominal reference phase (equal at all elements) in sequence such that (Δφ) times (n−1) is the phase set (via a phase shifter) at each element where the phase setting is a modulo 2π phase value. The modulo 2π means ±360 degrees of phase can be added to the phase value with no effect on the phase since all phases are relative.

Thus, since all the transmit signals from each radiator will be in phase (modulo 2π) at the in-phase line, an antenna beam (pointing direction) is established perpendicular to the in-phase line. The antenna beam characteristics are those typical (i.e., mainlobe and sidelobes) of a phased array antenna beam pattern. Thus, the antenna array beam pointing direction wavefront is established by the relative phase setting at each element and the transmitted wavefront from the antenna typically arrives in phase at the target. Now the return signal arrives as a plane wavefront from the target at the antenna and has the same relative phase differences along the in-phase line as the original beam started with. When this returning wavefront is sampled at each radiating element, the relative phase will have been delayed with respect to the in-phase line by the same relative phase value that would be needed at each element to steer an outgoing wavefront in the same direction that the incoming wave came from, except the sign of the phase would be reversed. This can be visualized by noting, in FIG. 4, the travel path to each element from the in-phase line.

Thus, if the incoming signal phase is conjugated to get the negative of the received phase and then this signal is re-radiated as the transmitted signal, the signal from that element will arrive at the in-phase line with a relative phase needed to add in phase with all other antenna elements and cause the beam to retrace the path of the incoming wavefront. Thus, the incoming wavefront has moved from the in-phase line with a relative phase $\phi$, and by conjugating $\phi$ to $-\phi$ the wavefront will retrace that path back to the in-phase line and thus travel from there in a direction that is perpendicular to the in-phase line.

For the case where there is intervening distortion in the path between this source wavefront and the phase conjugator (i.e., the antenna) the distortion is passed through twice (once in each direction) and any phase change will be removed by the double passage. Thus, by taking the phase conjugate (or negative) of the incoming sampled wavefront phase at each radiator in the array, the wavefront is directed back in the same direction it came from arid, also back through any interviewing distorting medium without any phase setting component (and associated phase control signal) in its path. It is assumed the distorting medium does not change during the relatively short time of the double signal passage.

In summary, phase conjugation removes the phase change that occurs as an incoming wavefront that is sampled by the antenna radiators travels from the in-phase line to each element of the antenna and back to the in-phase line. The signals traveling from each element to the in-phase line and back are shown in FIG. 4 by the double arrows on these waves. Any phase change added by a distorting medium that is both in the received and transmit path will be removed by the double passage of the wavefront as the beam passes through the medium and the phase conjugation supplied by the antenna will cause the incoming wavefront to retrace its path. The distorting medium will not affect the beam pointing established at the in-phase line. The paths inside the T/R module must not add any relative phase error, thus, each T/R module should be calibrated to be the same. Note that it is only this path through the phase conjugator in the T/R module and none of the other part of the RF system that will effect the described process of redirecting the incoming signal. Note also, that the actual mechanical alignment of the T/R modules will not effect the process of the signal redirection, other than the physical mechanical location requirement that could introduce antenna grating lobes.

Now the round trip from the in-phase line, to the array, through the phase conjugation, and back to the in-phase line removes the phase advance and retardation of the round trip and the retransmitted beam goes out in the direction it came from. The phase conjugation adds a phase to the received signal equivalent to the phase that a phase shifter adds to the transmitted signal of a conventional radar (CR) where the phase set is used to steer its beam in a given direction. Phase conjugation performs the function of the phase shifter on transmit, automatically setting the correct phase for beam steering.

Figure 5:
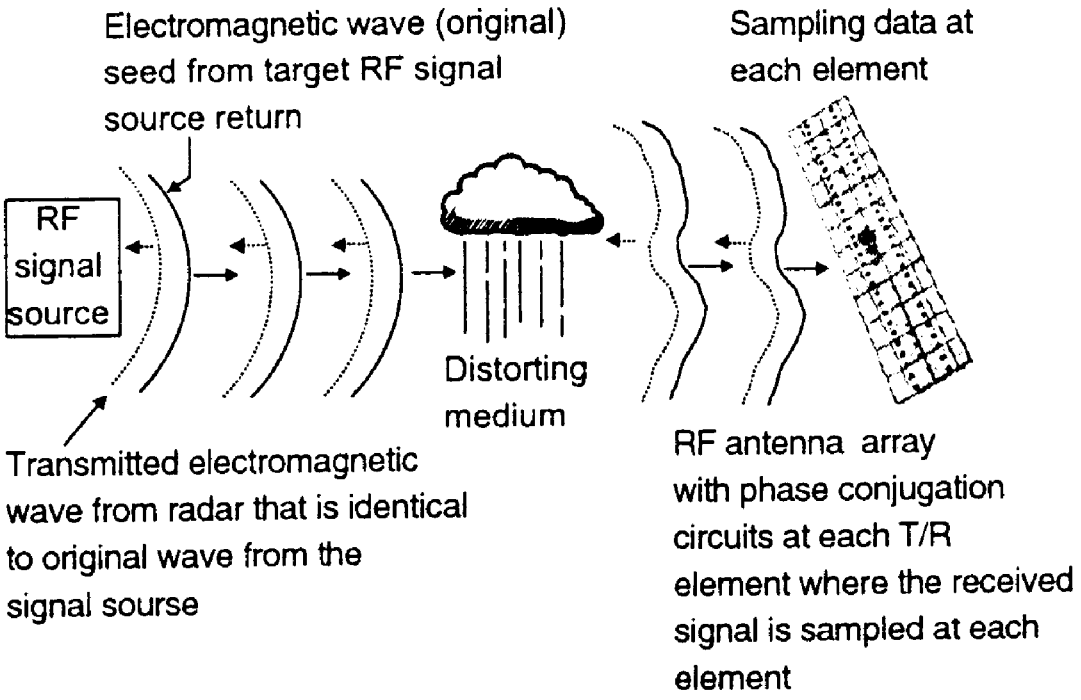
FIG. 5 is a graphic depiction of phase conjugation showing received signal redirection back to the signal source in accordance with the teachings of the present invention.

FIG. 5 is a graphic depiction of phase conjugation showing received signal redirection back to the signal source in accordance with the teachings of the present invention. Other circuits could also be included in the phase conjugating circuit in the T/R module for modifying the redirected signal, i.e., by additional phase or frequency shift to redirect the received signal to some other direction.

Thus, the present invention has been described herein with reference to a particular embodiment for a general application of signal redirection. There are numerous potential uses of this signal redirection such as in radar, communications, transponders, etc. Those having ordinary skill in the art and access to the present teachings will recognize those additional modifications, applications and embodiments within the scope thereof For example, the present teachings are not limited to a radio frequency implementation. The present teachings may be applied to systems operating at other frequencies of energy within the electromagnetic spectrum as well.

It is therefore intended by the appended claims to cover any and all such applications, modifications and embodiments within the scope of the present invention.

Accordingly,

What is claimed is:

1. A system for automatically generating a return beam in the direction of a received beam comprising:

first means for receiving a first signal having a first frequency and first wavefront from a first direction, wherein said first means is a phased array antenna comprising a plurality of radiating elements;

second means for providing a second signal having a second wavefront, said second signal being a phase conjugate of said first signal, said second means including a plurality of phase conjugators each of which are coupled to an associated radiating element to receive an input signal therefrom, each of said phase conjugators including a mixer having said input signal as a first input thereto, said input signal having said first frequency and a first phase;

third means for providing a second input to each of said mixers, said second input being derived from said first signal and being a second signal having a frequency equal to twice said first frequency such that the output of said mixer includes a component representative of the negative of said first phase; and fourth means for transmitting said second signal, whereby said second signal is transmitted in a reverse direction relative to the direction of said first signal.

2. The invention of claim 1 wherein said first signal is a radio frequency signal.

3. The invention of claim 1 wherein said second means includes means for filtering an output signal of each mixer to extract a component representative of a phase conjugate of said input signal.

4. The invention of claim 3 wherein said second means includes means for selectively transmitting the output of said means for filtering.

5. The invention of claim 1 where said second means is a phase conjugator.

6. A system for automatically generating a return beam in the direction of a received beam comprising:

a phased array antenna comprising a plurality of radiating elements;

a plurality of transmit/receive modules, each including a phase conjugator and being coupled to an associated one of said radiating elements, each of said phase conjugators including a mixer having said input signal as a first input thereto, said input signal having a first frequency and a first phase;

a reference module for providing a second input to each of said mixers, said second input being derived from said first signal and being a second signal having a frequency equal to twice said first frequency such that the output of said mixer includes a component representative of the negative of said first phase;

a receiver;

a corporate feed connecting the output of each of said modules to said receiver;

a signal processor connected to said receiver;

a data processor connected to said signal processor; and an input/output interface connected to said data processor.

7. The invention of claim 6 wherein said reference module includes a multiplier for providing said second signal.

8. The invention of claim 7 further including a filter for processing the output of each mixer to extract said component representative of the negative of said first phase.

9. A method for automatically generating a return beam in the direction of a received beam including the steps of:

receiving a first signal having a first wavefront from a first direction with a phased array antenna comprising a plurality of radiating elements;

providing a second signal having a second wavefront, said second signal being a phase conjugate of said first signal, said second signal being provided by a plurality of phase conjugators, each of said phase conjugates being coupled to an associated radiating element to receive an input signal therefrom, each of said phase conjugators including a mixer having said input signal as a first input thereto, said input signal having a first frequency and a first phase;

providing a second input to each of said mixers, said second input being derived from said first signal and being a second signal having a frequency equal to twice said first frequency such that the output of said mixer includes a component representative of the negative of said first phase; and transmitting said second signal, whereby said second signal is transmitted in a reverse direction relative to the direction of said first signal.

* * * * *